United States Patent [19]

Macnab

[11] 4,354,794

[45] Oct. 19, 1982

[54] CARRIAGE ASSEMBLY

[75] Inventor: John E. Macnab, Dallas, Oreg.

[73] Assignee: Towmotor Corporation, Mentor, Ohio

[21] Appl. No.: 251,529

[22] PCT Filed: Aug. 11, 1980

[86] PCT No.: PCT/US80/01041

§ 371 Date: Aug. 11, 1980

§ 102(e) Date: Aug. 11, 1980

[87] PCT Pub. No.: WO82/00455

PCT Pub. Date: Feb. 18, 1982

[51] Int. Cl.[3] ..... B66F 9/06

[52] U.S. Cl. ..... 414/607; 294/81 SF

[58] Field of Search ..... 414/607, 608, 629, 634–641; 294/81 SF, 67 DA, 750

[56] References Cited

U.S. PATENT DOCUMENTS

| | | | |
|---|---|---|---|
| 2,585,095 | 2/1952 | Daniels | 414/641 |
| 3,599,818 | 8/1971 | Stanton | 414/607 |
| 3,606,053 | 9/1971 | Whiteman | 414/608 X |
| 3,633,777 | 1/1972 | Snelling, Jr. | 414/608 |
| 3,764,032 | 10/1973 | Ward | 294/81 SF X |
| 3,974,927 | 8/1976 | Schuster | 414/750 |
| 3,982,644 | 9/1976 | Pease | 294/81 SF X |
| 4,165,008 | 8/1979 | Faust | 414/750 |

*Primary Examiner*—John J. Love
*Assistant Examiner*—Terrance L. Siemens
*Attorney, Agent, or Firm*—Alan J. Hickman

[57] ABSTRACT

This invention relates to a carriage assembly (28) for a lift mast (22). The carriage assembly has a frame (30), a pair of load supporting arms (64) pivotally connected to the frame at spaced locations on a lower portion (36) of the frame and pivotally connected to a guide bar (52) slidably connected to an upper portion (34) of the frame for permitting unitary movement of the load supporting arms relative to the frame transversely of the lift mast. The carriage assembly (28) is compact, lightweight and requires fewer parts. Thus, capacity, visibility, component life and performance are improved. The carriage assembly (10) is particularly useful on a vehicle (20) such as a lift truck.

17 Claims, 3 Drawing Figures

CARRIAGE ASSEMBLY

DESCRIPTION

1. Technical Field

This invention relates to a load handling apparatus and more particularly to a pivotally side shiftable carriage assembly for a lift truck mast.

2. Background Art

Carriage assemblies are known which have the ability to move both elevationally and laterally on a lift truck mast. Such carriage assemblies are known in the art as side shifting carriages and are useful where accuracy of load manipulation is critical and vehicle maneuverability must be held to a minimum. Such a side shifting carriage assembly is disclosed in U.S. Pat. No. 3,974,927, issued Aug. 17, 1976 to F. C. Schuster.

Typically, the lift mast is mounted on one end of the lift truck and a counterweight on the other. The carriage assembly includes numerous load engaging and support components which not only add weight to the load carrying end of the vehicle but cause the load supporting member to be positioned outwardly from the vehicle at a location spaced from its center of gravity to an extent adversely affecting the load carrying capacity of the vehicle. Therefore, it is necessary to increase the size and weight of the counterweight. This, however, tends to increase the length of the vehicle resulting in an increase in turning radius, which is detrimental to its maneuverability, stability, and performance. In addition to the aforementioned problems, this clutter of parts adds structural bulk to the functional end of the vehicle and reduces visibility from the operator's compartment. Reference is made to U.S. Pat. No. 4,165,008, issued Aug. 21, 1979 to D. M. Faust et al and U.S. Pat. No. 3,633,777 issued Jan. 11, 1972 to Murdock M. Snelling, Jr. et al.

Therefore, the prior art designs are costly, complex and are plagued with problems and deficiencies. The present invention is directed to overcoming one or more of the problems as set forth above.

DISCLOSURE OF INVENTION

In one aspect of the present invention, a lift truck mast carriage assembly is provided for elevationally movably supporting a load which is also capable of moving the load transversely to the normally upright attitude of the lift mast. The carriage assembly includes first and second load supporting arms each being pivotally connected to a frame of the carriage at spaced apart locations on the frame and means movably connecting the load supporting arms to the frame for permitting unitary movement of the load supporting arms relative to the frame only transversely of the lift mast.

BEST MODE FOR CARRYING OUT THE INVENTION

Figure 1:
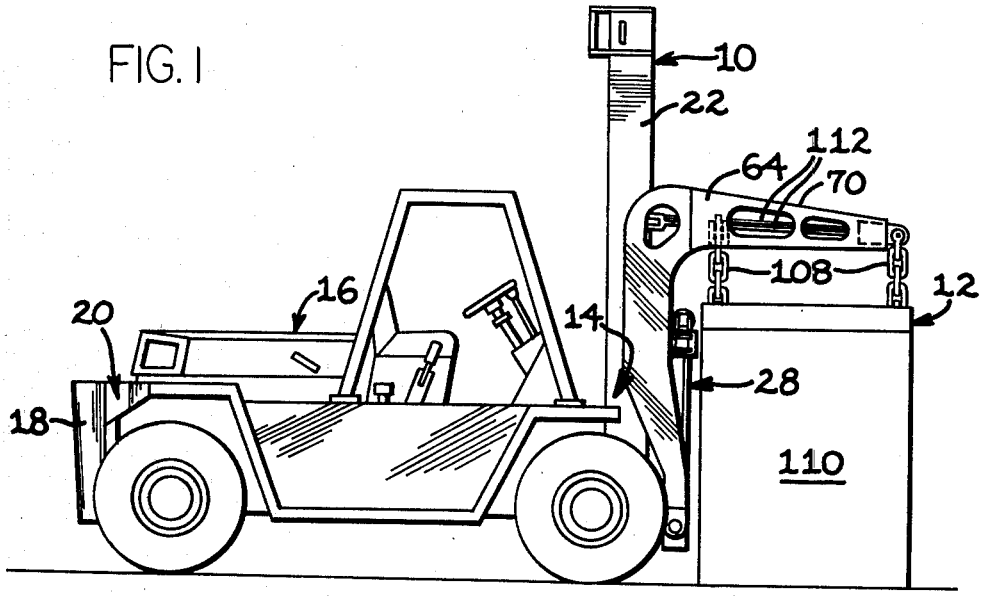
FIG. 1 is a diagrammatic side elevational view of a lift truck supporting the carriage assembly of the present invention.

Referring to the drawings, a lift assembly 10 for a container handling attachment 12 is mounted on one end 14 of the lift truck 16 and a counterweight 18 is mounted on an other end 20.

The lift assembly 10 includes a lift mast 22 having a pair of fixed spaced apart uprights 24 pivotally connected to the end 14 of the lift truck 16 and a pair of movable spaced apart uprights 26 mounted on and elevationally movable along the fixed uprights 24 all in a conventional manner.

A carriage assembly 28 includes a rigid frame 30 having a pair of spaced roller brackets 32, an upper tubular guide beam 34 defining an upper end portion and a lower support beam 36 defining a lower end portion. The frame 30 is mounted on the movable uprights 26 by rollers 42 connected to each of the roller brackets 32 and elevationally movable along the movable uprights. The movable uprights 26 and the frame 30 are each elevationally movable along the member upon which they are mounted in any suitable well known manner such as by a jack, sheave and chain arrangement (not shown).

An upper end portion 38 of each of the roller brackets 32 is affixed to the guide beam 34 and a lower end portion 40 of each of the roller brackets is affixed to the support beam, such as by welding. It is to be noted that the roller brackets 32 are spaced from and substantially parallel to each other and the upper guide and lower support beams 34,36 are spaced from and substantially parallel to each other.

The tubular upper guide beam 34 has opposite ends 44,46 and opening transversely of the lift mast 22 on opposite sides of a longitudinal vertical center plane 49 passing through the center of gravity of the vehicle 16. An end cap 48 having an aperture 50 disposed therethrough is rigidly secured to each of the opposite ends 44,46 with the aperture in alignment with one another transversely of the lift mast 22 and normal to the longitudinal center plane 49 of the vehicle. A guide bar 52 has opposite end portions 56,58 and is disposed in the tubular guide beam 34 with the opposite end portions extending through the aperture 50 of their respective end caps. The guide bar 52 is in slidable bearing contact with a pair of front and rear surfaces 54 and 55, respectively, and spaced from a pair of upper 57 and lower 59 surfaces respectively, within the end caps and defining the apertures 50. Thus, the guide bar is constrained by the surfaces 54,55 for movement only transverse to the lift mast and across center plane 49 of the vehicle 16. Clearance is provided between the upper 51 and lower 59 surfaces and the guide bar 52 to permit a predetermined amount of maximum elevational movement of the guide bar and eliminate vertical loading thereof.

The lower support beam 36 has opposite end portions 60,62 which have a reduced diameter portion 63. The lower support beam is substantially the same length as the guide bar 52.

A pair of load supporting "L" shaped arms 64 each has a lower end portion 66, a middle portion 68, and an upper end portion 70. The arms 64 are individually pivotally connected at the lower end portion to the opposite end portions 60,62 of the lower support beam 36 and at the middle portion 68 to opposite end portions 56,58 of the guide bar 52 preferably by a spherical bearing assembly 72. However, other types of pivotal connections are feasible and within the scope of this invention. It is to be noted both arms are connected to the guide bar 52 and support beam 36, respectively, by the spherical bearing assembly in an identical manner.

Figure 3:
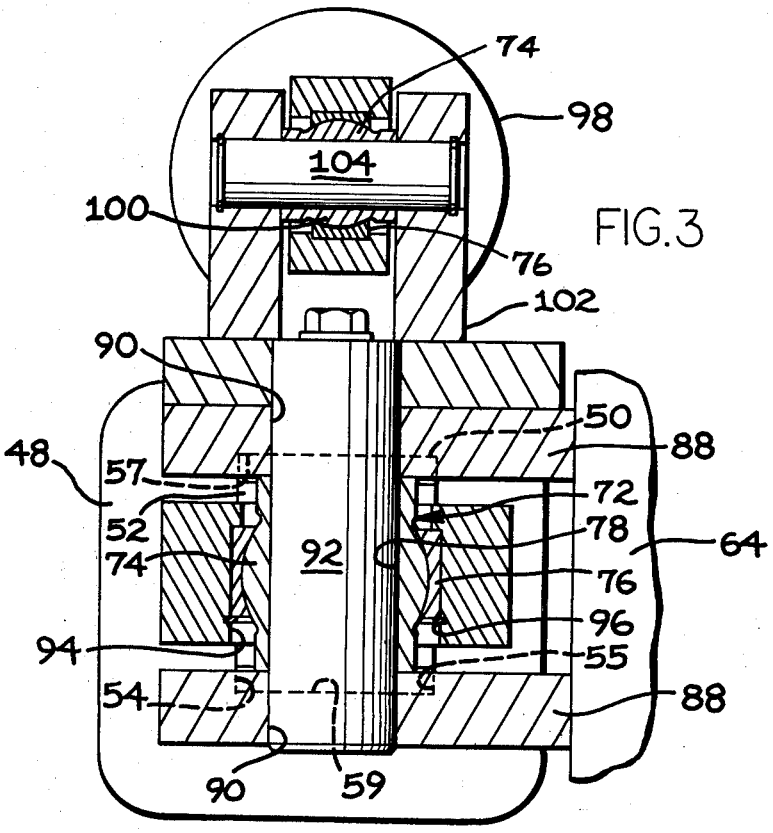
FIG. 3 is a somewhat enlarged sectional view through a portion of the carriage assembly taken along line III—III of FIG. 2.
Figure 2:
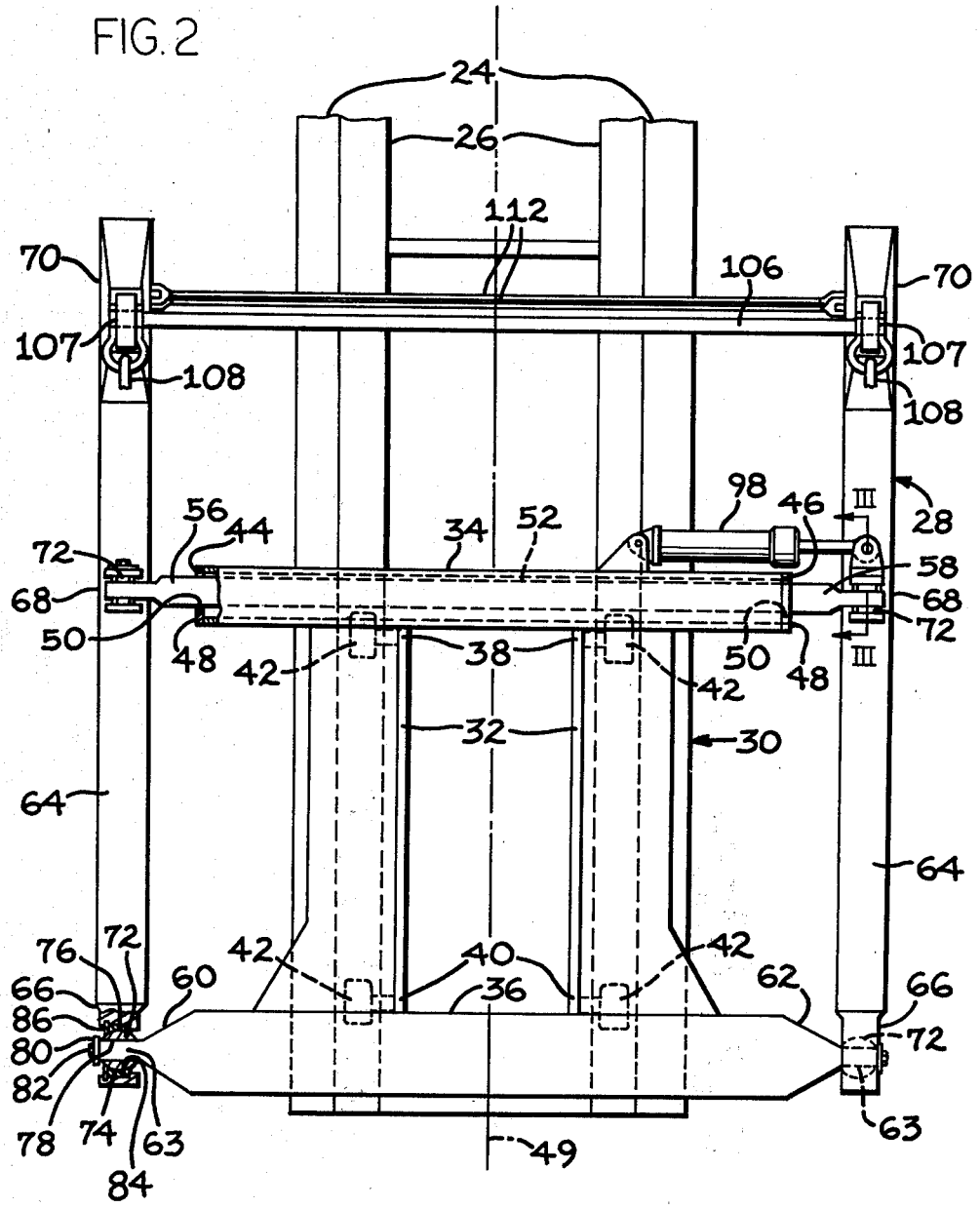
FIG. 2 is a diagrammatic front elevational view of the carriage assembly of FIG. 1.

Each of the spherical bearing assemblies 72 (FIG. 3) has a spherical ball 74 and a mating spherical seat 76 surrounding the spherical ball. The spherical ball has a bore 78 disposed therethrough for mounting purposes.

Each arm 64 is pivotally connected to its adjacently associated end portions 60,62 of the lower support beam 36 in the following manner. The bore 78 of the spherical ball 74 is mounted on reduced diameter portion 63 of the lower support beam. The spherical ball is retained from axial movement on the reduced diameter portion in any suitable manner such as by a washer 80 and bolt 82 screw threadably secured to the reduced diameter portion. The mating spherical seat 76 is positioned in a stepped bore 84 in the lower end portion 66 of the arms 64 and retained therein in any suitable manner such as by a snap ring 86.

Each arm 64 is pivotly connected to its adjacently associated end portion 56,58 of the guide bar 52 in the preferred following manner. The spherical ball 74 is positioned between a clevis 88 having a through bore 90. The clevis is connected to and extending from each support arm 64. The clevis bore 90 and spherical ball bore 78 are aligned and a pin 92 is disposed in the bores 78 and 90 and retained therein in any suitable fashion. The mating spherical seat 76 is positioned in a stepped bore 94 in opposite end portions 56,58 of the guide bar and retained therein by a snap ring 96.

The spherical bearing connection of the guide bar 52 and lower support beam 36 to the arms 64 supports the arms in a predetermined upright attitude while permitting a slight amount of swingable arm movement to reduce the possibility of damage to the components and their connections when under the influence of an externally applied transverse force. This will be described in greater detail in subsequent discussion.

It is to be noted the pair of arms 64, and the guide bar 52 and support beam 36 are maintained substantially parallel to each other at all times and describe a parallelogram.

A jack 98 is connected at one end to one of the load supporting arms 64 and guide bar 52 by a spherical bearing assembly 100 connected to a clevis 102 secured to the clevis 88 of one of the load supporting arms 64 via a pin 104 in the same manner as the load supporting arms 64 are connected to the guide bar 52. The other end of the jack is pivotally connected to the frame 30 and guide beam 34 in any suitable manner. The jack is provided for moving the load supporting arms 64.

The upper end portion 70 of the load supporting arms 64 are pivotally connected to each other by a tie rod arrangement 106 having spherical bearings 107 at opposite ends in the same manner as the connection of the arms 64 to the lower support beam 36 for restraining the upper end portion of the arms at a predetermined spaced distance from each other. An "X" brace 112 of flexible cable is connected to and between the upper end portion 70 of the arms 64 to stabilize the arms and permit only a slight amount of pivotal movement thereof when under the influence of a transverse force.

The container handling attachment 12 is preferably hung from the upper end portion 70 of the arms 64 by spaced chains 108 connected to the upper end portion 70 and the container handling attachment 12. The container handling attachment is well known in the art as a device for connecting a container 100 to be lifted to a lifting apparatus and will not be described in detail.

In view of the foregoing, there is provided a pivotally shiftable carriage assembly of simple construction which is capable of moving a load transversely to the mast and vehicle upon which it is mounted.

Industrial Applicability

In operation, the lift truck 16 is maneuvered to a position with the lift mast 22 adjacent the load 110 to be lifted. The lift truck operator then positions the container handling attachment 12 in exact alignment with and above the container 110 to be lifted by shifting the load supporting arms 64 in unison transversely of the mast and to either side of the vehicle 16 to where the load is located by actuation of the jack 98. Actuation of the jack causes the guide bar 52 to move transversely in the guide beam 34 resulting in pivotal movement of the load supporting arms 64 about their respective connections to the support beam 36. Because of the uncluttered construction of the pivotally shiftable carriage assembly 28, the operator can clearly see when the container handling attachment 12 is moved into alignment with the container 110.

Upon reaching alignment, the operator lowers the carriage assembly 28 until the attachment is resting on the container 110. The container handling attachment 12 is then connected to the container by a plurality of twist locks, not shown, in a conventional manner. The carriage assembly and container 110 are then raised to a suitable travel height.

Jack 98 is then actuated to pivotally shift the arms 64 in unison through movement of the guide bar 52 about their respective pivotal connections on the lower support beam 36 until they are each positioned equi-distant from their respectively adjacent ends 44,46 of guide beam 34. In this position the arms 64 are generally vertical and the container handling attachment 12 is transversely centered relative to the longitudinal center plane 49 of the lift truck 16. The forward component of force created by the load 110 acting on the arms is transferred to the frame 30 by the guide bar 52 and the rearward and vertical force is transferred to the frame at the pivotal connection on the lower support beam 36.

The lift truck 16 is then driven to a location where the load 110 is to be deposited. If during loading, unloading or travel, the load supporting arms 64 should come in forcible contact with an obstruction placing a transverse load on the upper end portion 70 of arms 64, the construction aforementioned will permit each of the arms to pivotly swing about their upper and lower spherical bearings 72 a slight amount and in unison thereby reducing the possibility of damage to the arms or associated componentry.

Once the vehicle has reached its destination, the operator may position the load accurately and quickly relative to the deposit location by manipulation of the lift mast 22 and pivotally shiftable carriage 28 in a manner reverse to that previously described.

It is to be noted that the construction of the carriage assembly 22 improves visibility through a reduction in the number, location and compactness of parts which reduces wear, binding and premature failure of the carriage assembly 28 and maintains the carriage assembly as close to the front end 14 of the vehicle as possible therefore increasing capacity and improving maneuverability.

Other aspects, objects and advantages of the invention can be obtained from a study of the drawings, disclosure and appended claims.

I claim:

1. A carriage assembly (28) for a lift mast (22), comprising:

a frame (30) having elevationally spaced support (36) and guide (34) beams elevationally positionably mounted on said lift mast (22) with said support beam having opposite end portions (60,62);

a pair of load supporting arms (64) each individually pivotally connected to opposite end portions (60,62) of said support beam and extending therefrom in passing relation to said guide beam (34); and means (52,48,72) for movably connecting said load supporting arms (64) to said guide beam (34) and permitting unitary pivotal movement of the load supporting arms (64) about said pivotal connections and sideways relative to the lift mast (22).

2. The carriage assembly as set forth in claim 1 wherein said movable connecting means (48,72) includes a guide bar (52) slidably disposed in a tubular opening (44,46) in said guide beam (34) and extending transversely of said lift mast (22).

3. The carriage assembly (28) as set forth in claim 2 wherein said guide bar (52) has predetermined opposite end portions (56,58) pivotally connected to their respectively adjacent load supporting arms (64).

4. The carriage assembly (28) as set forth in claim 3 wherein said guide beam (34) has an end cap (48) affixed to each of said opposite ends (44,46) thereof for slidably supporting said guide bar (52) in a direction transversely of said lift mast (22).

5. The carriage assembly (28) as set forth in claim 4 wherein each of said end caps (48) has a front (54), rear (55), upper (57), and lower (59) surface defining an aperture; said guide bar being disposed in said apertures (50) and slidably bearingly supported by said front (54) and rear (55) surfaces.

6. The carriage assembly (28) as set forth in claim 3 wherein said guide bar (52) is pivotally connected to each of the load supporting arms (64) at opposite end portions (56,58) by a spherical bearing assembly (72) having a spherical ball (74) and a mating spherical seat (76).

7. The carriage assembly (28) as set forth in claim 1 including a jack (98) connected to said frame (30) and one of said pairs of load supporting arms (64).

8. The carriage assembly as set forth in claim 3 including a hydraulic jack (98) connected to said guide bar (52) and said guide beam (34).

9. The carriage assembly (28) as set forth in claim 1 wherein said pair of load supporting arms (64) are each individually pivotally connected to opposite end portions (60,62) of said support beam (36) by a spherical bearing assembly (72) having a spherical ball (74) and a mating spherical seat (76).

10. In a lift assembly (10) for a container handling attachment (12) having a lift mast (22), a carriage assembly (28) including a frame (30) providing predetermined upper (34,38) and lower (36,40) end portions and elevationally positionably mounted on the lift mast (22), the improvement comprising:

a pair of load supporting arms (64) each having a lower end portion (66) and being individually pivotally connected at their lower end portion (66) at spaced locations (60,62) on the lower (36) end portion of said frame (30); and means (52,34,48,72) for movably connecting said load supporting arms (64) to the upper end portion (34) of said frame (30) permitting unitary movement of said load supporting arms (64) about said pivotal connection transversely to said lift mast (22).

11. The lift assembly (10) as set forth in claim 10 wherein said connecting means (52,34,48,72) includes a guide bar (52) slidably connected to the upper end portion (34,38) of the frame (30) and pivotally connected to and disposed between said pair of load supporting arms (64).

12. The lift assembly (10) as set forth in claim 11 wherein said upper end portion (34,38) of said frame (30) includes a tubular guide beam (34) having opposite ends (44,46) opening transversely of said lift mast (22) and slidably supporting said guide bar (52) in telescoping relation.

13. The lift assembly (10) as set forth in claim 11 wherein said guide bar (52) includes opposite end portions (56,58) each being pivotally connected to a respective one of said pair of load supporting arms (64) by a spherical bearing assembly (72) having a spherical ball (74) and mating spherical seat (76).

14. The lift assembly (10) as set forth in claim 10 wherein said lower end portions (36,40) of said frame (30) includes a support beam (36) extending transversely of said lift mast (22) and having opposite end portions (60,62) defining said spaced locations on the lower end portion (36,40) of said frame (30).

15. The lift assembly (10) as set forth in claim 14 wherein said pair of support arms (64) are each pivotally connected to a respective end portion (60,62) of the support beam (36) by a spherical bearing assembly (72) having a spherical ball (74) and mating spherical seat (76).

16. The lift assembly as set forth in claim 15 wherein said movable connecting means (52,34,48,72) includes a guide bar (52) having predetermined oppositely spaced end portions (56,58) pivotally connected to their respectively adjacent load supporting arms (62); said guide bar (52), support beam (36) and spaced arms (64) forming a parallelogram.

17. The lift assembly (10) as set forth in claim 13 including a hydraulic jack (98) connected to said guide beam (34) and one of said pair of load supporting arms (64).

* * * * *